United States Patent [19]

Nicholas

[11] Patent Number: 4,625,485

[45] Date of Patent: Dec. 2, 1986

[54] ELASTOMERIC GLANDS

[75] Inventor: John D. Nicholas, Tucker, Ga.

[73] Assignee: MM Systems Corporation, Tucker, Ga.

[21] Appl. No.: 818,704

[22] Filed: Jan. 14, 1986

[51] Int. Cl.[4] ..... E01C 11/10

[52] U.S. Cl. ..... 52/396; 52/403; 404/64

[58] Field of Search ..... 52/396, 403, 393; 404/64–69, 87; 49/475

[56] References Cited

U.S. PATENT DOCUMENTS

| | | | |
|---|---|---|---|
| 3,720,142 | 3/1973 | Pare | 404/67 |
| 4,043,693 | 8/1977 | Brown | 404/64 |
| 4,098,043 | 7/1978 | McCready | 52/396 X |
| 4,119,387 | 10/1978 | Brown | 52/396 X |
| 4,148,167 | 4/1979 | Puccio | 52/396 |
| 4,351,622 | 9/1982 | Kerschner | 52/396 X |
| 4,362,428 | 12/1982 | Kerschner | 52/396 X |
| 4,457,522 | 7/1984 | Trieste et al. | 404/64 X |

*Primary Examiner*—J. Karl Bell

*Attorney, Agent, or Firm*—John B. Armentrout

[57] ABSTRACT

Elastomeric multi-tubular glands, which are adapted to exert reactive thrust when the gland is compressed and relieved within a movement tolerance space between relatively movable bodies, are provided, featuring a generally hexagonal wall member and a strut wall inside the hexagonal wall member, for the strut wall to share I-beam properties with front and back side walls of the hexagonal wall member, having the gland further include opposed means connected with the hexagonal wall member adjacent to a pair of apexes formed by the remaining side walls of the hexagonal wall member, for the opposed means to press and relieve the hexagonal wall member in response to the relative movement of the bodies while the gland leads laterally across the movement tolerance space between the bodies. In certain embodiments, mount fixtures are provided in system with the gland so as to be secured to the bodies as components thereof and carry the gland.

22 Claims, 6 Drawing Figures

ELASTOMERIC GLANDS

The present invention relates to elastomeric glands, and gland and mount systems, and to their use in association with relatively movable bodies which form a movement tolerance space with one another for the space to be closed off by the gland.

An object of this invention is to achieve elastomeric glands which resiliently and structurally are well suited to be reduced in width and to increase in width in coacting with relatively movable bodies, having the gland meanwhile close off a movement tolerance space between the bodies.

Another object of this invention is the provision of practical and reliable elastomeric glands and to introduce elastomeric truss structures in the gland allowing change in width of the gland laterally between relatively movable bodies over a quite worthwhile permissible compression and relaxation range of the gland.

A further object herein is to provide elastomeric glands of the character indicated which resist being distended at outer face of the gland while the gland is presented between relatively movable bodies and laterally is being compressed and relieved to act within the compression and relaxation range of the gland.

Another object of this invention is the provision of elastomeric glands of the character indicated which favorably elastically deflect and resume initial position when exposed to loads applied to a front face of the gland while the gland is closing off a movement tolerance space between relatively movable bodies.

Another object is to provide, in certain embodiments of this invention, gland and mount systems and installations thereof wherein an elastomeric gland of the character indicated is associated with mounts therefor.

Other objects herein in part will be obvious and in part pointed out more fully hereinafter.

Turning to examples of demands which are to be satisfied within the practice of the present invention, elastomeric glands often are needed for use as expansion joint components or, more generally, as components having utility between relatively movable bodies. Some of these demands arise within the highway paving or sidewalk paving arts wherein sections of a pavement, such as of concrete, are produced with spaces between the sections, thus allowing relative movement of the sections to occur due primarily to expansion and contraction from temperature changes while the sections are in place. The spaces between the sections accordingly offer protection against having the sections meet endwise and thereafter compress to the point of failure from overload. Elastomeric glands are installed within the movement tolerance spaces between the sections in order to follow the relative movement of the sections and afford continuity between the sections while covering the movement tolerance spaces.

Among other more particular uses for elastomeric glands are those which apply to floors of bridges that are constructed to carry vehicular traffic, with sections of the bridge floor being spaced apart having the elastomeric glands therebetween to complete the joints and protect the sections from directly meeting one against the other because of thermally expanding or being subjected to vibrations. Further, in such structures as floors, walls, ceilings, roofs, or the like, of buildings, it sometimes becomes important to add elastomeric glands between straight away sections or panels, or in corner locations such as at wall to wall junctions, floor to wall junctions or ceiling to wall junctions, to account for thermal expansion or contraction and sometimes also to protect against damage from earth termors or other vibrational hazards.

Should the elastomeric glands be ones which are to be exposed outdoors, valleys in the upper surface of the gland are beneficial for carrying off water, and yet allowing the gland to fold and unfold when being compressed and relieved. Ridge structure, when offered between valleys at the outer face of the gland, also can be beneficial such as for adding frontal surface area between the relatively movable bodies while the gland covers and thus shields the movement tolerance space, and in instances where the gland is installed having the ridge structure upwardly faced near the outside of the movement tolerance space between relatively movable bodies in a pavement or the like, the ridge structure may serve as a land to be encountered by foot or wheel traffic.

It will of course be realized that many forms of heretofore known elastomeric glands are not well suited for use within a movement tolerance space between relatively movable bodies. A longitudinally multi-tubular truss-like gland for the latter purpose is to advantage, but many types of glands from the prior art, though longitudinally hollow in structure, have transverse cross sectional configurations which demonstrate poor truss behavior while the gland is being altered in width within a movement tolerance space between relatively movable bodies. Other truss structures provided by longitudinally hollow tubular glands heretofore known have to be ruled out because of being far too complex to satisfy simplicity and, at best, glands of the latter types lead to added cost of production.

A further object of this invention accordingly is to achieve longitudinally multi-tubular elastomeric glands providing truss structure that is well regulated to be simple in configuration and yet affords valley and ridge aspects frontally and is satisfactorily braced within itself, and is enabled to operate in an orderly fashion of folding and unfolding elastically over a favorably long compression and relaxation range, and becomes highly compact as the result of orderly folding while reaching the compression end of the permissible folding and unfolding range under conditions of meanwhile offering restraint against being distended at outer face frontally.

In accordance with practice of the present invention, longitudinally multi-tubular elastomeric glands are provided for the gland to operate inside a movement tolerance space between relatively movable bodies. A generally hexagonal wall member, which is tubular longitudinally of the gland, is laterally centrally disposed within the gland, and there is an intermediate strut wall inside the hexagonal wall member which interconnects a first pair of side walls of the hexagonal wall member medially of the first pair of side walls so as to produce an I-beam aspect with the latter two side walls prior to the hexagonal wall member being compressed. Second and third pairs of side walls of the hexagonal wall member interconnect opposite lateral ends of the first pair of side walls and form a pair of apexes which are spaced oppositely of the intermediate strut wall about equidistantly from opposite sides of the intermediate strut wall.

Preferably, the side walls of the hexagonal wall member, in the aforementioned first pair, are about equilateral and so are the remaining four side walls of the hexagonal wall member about equilateral, this with having the hexagonal wall member accordingly provide six approximately equal obtuse angles between the several side walls thereof, and with having the first pair of side walls of the hexagonal wall member be of a width which is either somewhat more or less than or about equal to that of the other four side walls of the hexagonal wall member, yet having the aforementioned I-beam aspect be provided by the intermediate strut wall in conjunction with the first pair of side walls of the hexagonal wall member.

Side end and connecting structure, appurtenant to the hexagonal wall member and intermediate strut wall hereinbefore described, includes opposite side end means, such as a pair of outer strut walls, to be against the relatively movable bodies when the gland is inside the movement tolerance space. In certain embodiments, the relatively movable bodies are equipped with mounts as fixtures thereto having the mounts carry the opposite lateral end means of the gland, and in other embodiments the outer strut walls are abutted against the relatively movable bodies within the movement tolerance space in the absence of mount fixtures. Further, there are two pairs of slanted connecting walls in the side end and connecting structure of the gland. These two pairs of slanted connecting walls are connected with second and third pairs of side walls of the hexagonal wall member, which second and third side walls constitute the aforementioned other four side walls of the hexagonal wall member supplementing the first pair of side walls of the hexagonal wall member. The two pairs of slanted connecting walls intersect the second and third pairs of side walls of the hexagonal wall member contiguous to the apexes formed by the second and third pairs of side walls of the hexagonal wall member with one another, and the slanted connecting walls are joined at those intersections to the second and third pairs of side walls of the hexagonal wall member. The latter intersections preferably are removed by about the same distance along the second and third side walls of the hexagonal wall member from the opposite lateral ends of the first pair of side walls of the hexagonal wall member so as to be away from the opposite lateral ends of the first pair of side walls of the hexagonal wall member by at least about half way between the first pair of side walls of the hexagonal wall member and the pair of apexes formed by the second and third side walls of the hexagonal wall member.

In certain embodiments, the two pairs of the slanted connecting walls have intersections at one and the other of the pair of apexes formed by the second and third pairs of side walls of the hexagonal wall member, and in other embodiments one or both of the two pairs of slanted connecting walls have intersections with the second and third pairs of side walls of the hexagonal wall member, with two or all of those intersections being aside from the pair of apexes produced by the second and third pair of side walls of the hexagonal wall member. In any event, the slanted connecting walls in one of the pairs thereof diverge with reference to the slanted connecting walls in the other pair thereof, as the slanted connecting walls lead away from the hexagonal wall member, having the slanted connecting walls interconnect the second and third pairs of side walls of the hexagonal wall member with the opposite side end means of the gland, such as with opposite lateral ends of an outer pair of strut walls of the gland. Glands so constructed lend themselves to being produced by extrusion, and preferably are approximately symmetrical bilaterally having the intermediate strut wall of the gland as a reference for the bi-lateral symmetry which accordingly prevails outwardly to the opposite side end means of the gland.

The gland structure is arranged so that the second and third pairs of side walls of the hexagonal wall member will flex about the opposite lateral ends of the first pair of side walls of the hexagonal wall member under thrust from the two pairs of slanted connecting walls, and thereby will carry the pair of apexes produced by the second and third pairs of side walls of the hexagonal wall member toward the opposite sides of the intermediate strut wall inside the hexagonal wall member. Ultimately, when the gland is fully compressed, the second and third pair of side walls of the hexagonal wall member will facially be against the opposite sides of the intermediate strut wall, with the intermediate strut wall in conjunction with the first pair of side walls of the hexagonal wall member still appreciably preserving the I-beam aspect. The intermediate strut wall is placed under tension during compression of the gland within the compression and relaxation range of the gland, and thereby arrests outward distension of the gland in the regions of the opposite lateral ends of the intermediate strut wall while also contributing self-bracing features to the gland. The opposite side end means preferably has forward and rearward portions connected with the slanted connecting walls so as to allow the slanted connecting walls, which also contribute bracing in the gland, to flex adjacent to the forward and rearward portions of the opposite side end means, and thereafter continue to flex until being side facially against the opposite side end means by the time that the gland reaches the fully compressed condition.

In embodiments which are preferred, the side walls in at least one of the second and third pairs of side walls of the hexagonal wall member are components of diagonal walls, which extend from front to back of the gland and also include the walls occurring in at least one of the two pairs of slanted connecting walls. The diagonal walls quite satisfactorily add bracing, and yet allow the gland to fold and unfold elastically while the gland undergoes movement within the existing permissably long compression and relaxation range of the gland.

As pointed out to some extent hereinbefore, in certain practices in accordance with this invention, mounts, such as of metal, are provided in system with the gland, for the mounts to be affixed to the relatively movable bodies and thus be components of the bodies to carry the gland. An adhesive or other suitable anchoring means may of course be employed for fastening the gland to the mounts or directly to the relatively movable bodies when mounts are omitted. In other instances, the opposite lateral end structure of the gland is modified such as to be embedded in the relatively movable bodies or to include anchors engaged with anchor receptacle structure of the mounts. By installing the gland partially compressed initially, the gland produces reactive thrust against the mounts or directly against the relatively movable bodies, and sometimes this alone is found to be sufficient for maintaining the glands in situ.

Elastomeric gland structure hereinbefore described lends itself to being further supplemented in accordance with this invention by having loop wall means interconnect the opposite lateral ends of the rearward one of the first pair of side walls of the hexagonal wall member with rearward lateral portions of the opposite side end means of the gland, thus to have the gland be further plurally tubular and further self-bracing. Several illustrative embodiments relating to glands in the latter category will hereinafter be described.

In the accompanying drawings representing embodiments of this invention which presently are preferred:

FIG. 1 is a transverse cross sectional view of an elastomeric gland installed with mount means on relatively movable bodies, and the view is isometrically prolonged to represent a brief portion of the installation extending longitudinally of the gland;

FIG. 1*a* is a transverse cross sectional view solely of the gland in FIG. 1 and representing the gland when the latter is in about a fully compressed condition side to side;

Figure 2:
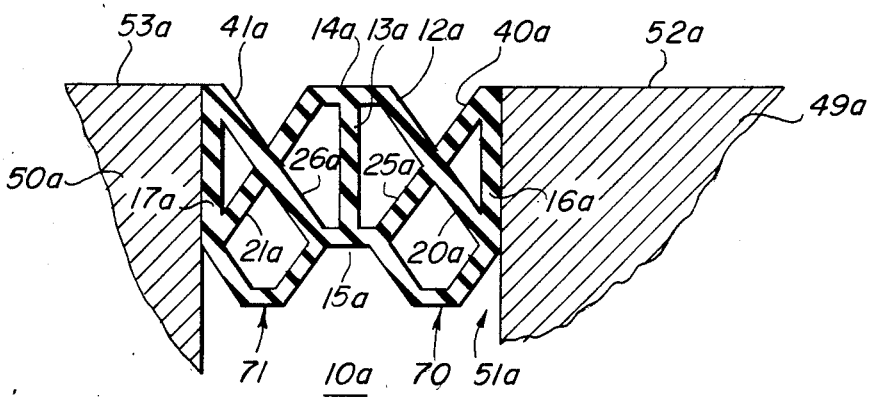
FIG. 2 is a transverse cross sectional representation of an elastomeric gland, and installation, with the gland being characterized by having loop wall structures in the truss configuration.
Figure 3:
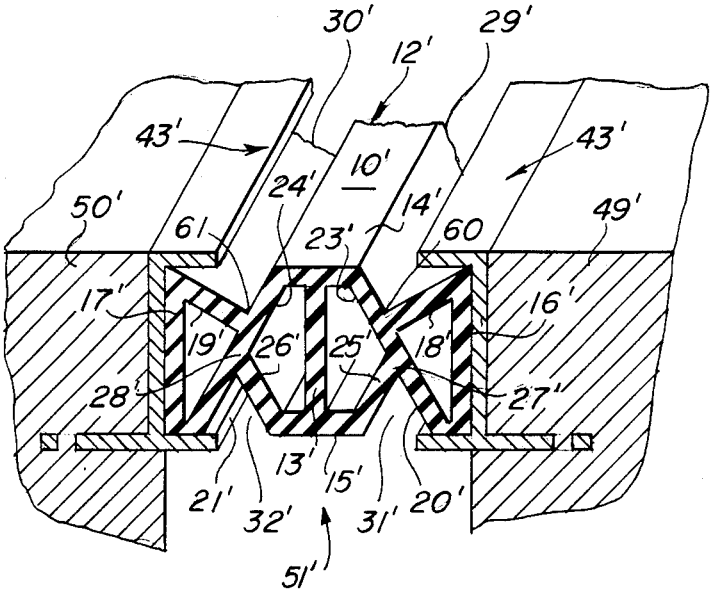
FIG. 3 is a transverse cross sectional view of a modified type of elastomeric gland installed with mount means on relatively movable bodies, and the view isometrically is somewhat prolonged as in FIG. 1.
Figure 3A:
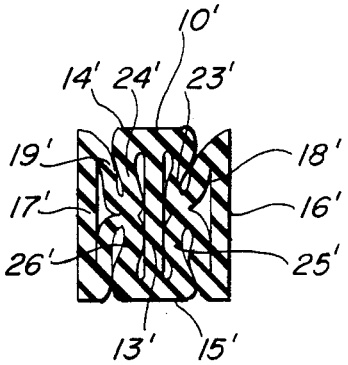
Figure 4:
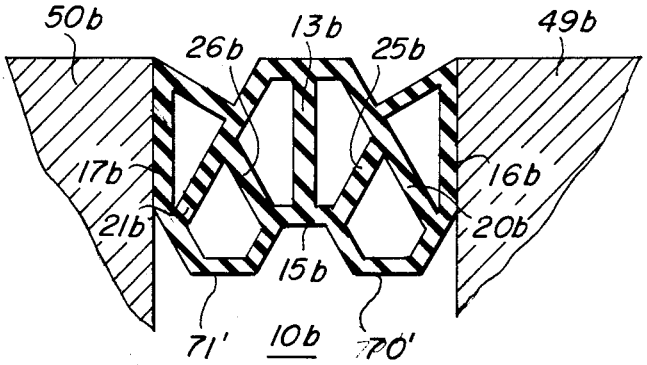

FIG. 3*a* corresponds to FIG. 3 and represents the gland in transverse cross section having the gland in approximately fully compressed condition; and FIG. 4 is a view akin to that of FIG. 2 and represents still another elastomeric gland of modified form.

To enable a better understanding of structure, the glands as represented in FIGS. 1, 2, 3 and 4 are in approximately a fully relaxed condition; however, under many circumstances the gland initially is best installed partially compressed to allow the movement tolerance space between the relatively movable bodies subsequently to increase and decrease in width, as may occur, in keeping with the lateral compression and relaxation range of the gland.

Figure 1:
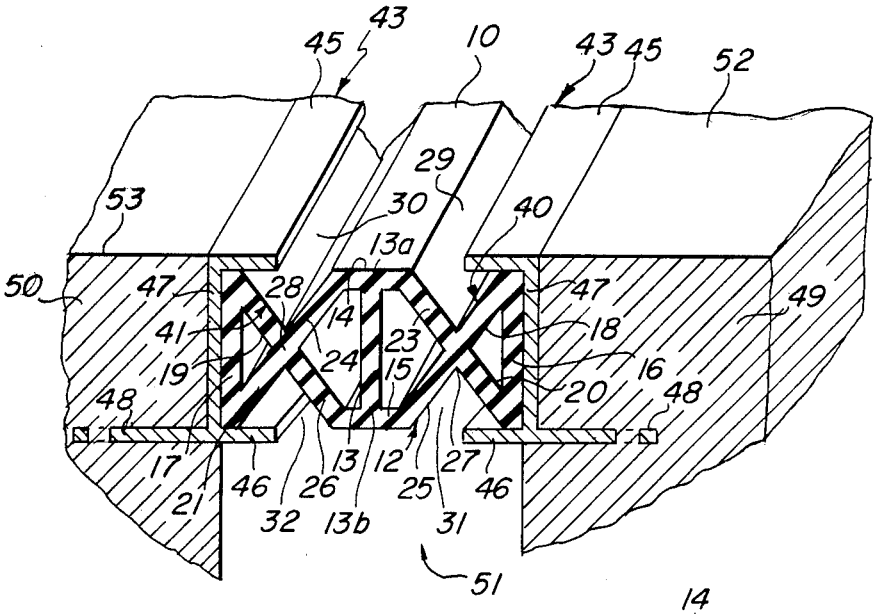

Referring now more particularly to the longitudinally multi-tubular elastomeric gland 10 according to FIG. 1, a hollow generally hexagonal wall member 12 of the gland longitudinally co-extends with an intermediate strut wall 13 of the gland which is inside the hexagonal wall member. Strut wall 13 is disposed laterally centrally of the gland 10, and has junctions 13*a* and 13*b* with a first pair of side walls 14 and 15 of the hexagonal wall member medially of the side walls 14 and 15. The side walls 14 and 15 in the first pair are approximately equilateral and, as represented in FIG. 1, occupy front and back positions respectively in the installation. A second pair of side walls 23 and 24 of the hexagonal wall member 12 and a third pair of side walls 25 and 26, also of the hexagonal wall member 12, interconnect opposite lateral ends of the first pair of side walls 14 and 15 and in doing so intersect at junctions 27 and 28, thus providing apexes of the hexagonal wall member 12 at those junctions, with the junctions being spaced about equidistantly from opposite sides of the intermediate strut wall 13. Side walls 14, 15, 23, 24, 25 and 26 define six approximately equal obtuse angles with one another and the side walls 23, 24, 25 and 26 all are about equilateral. The side walls 14 and 15 in conjunction with the intermediate strut wall 13 define a longitudinally extending I-beam laterally centrally of the gland 10, and although the side walls 14 and 15 as hereinbefore described are about equilateral with reference to one another, it remains that the width of side walls 14 and 15 may optionally be somewhat more or less than or about equal to that of the side walls 23, 24, 25 and 26, having the hexagonal wall member 12 nevertheless form two generally pentagonal tubes in the gland 10 with the intermediate strut wall 13, enabling the I-beam feature afforded by the intermediate strut wall 13 in conjunction with the first pair of side walls 14 and 15 to be present.

The elastomeric gland 10 is a product of extrusion wherein the hexagonal wall member 12 is laterally centrally disposed between a pair of laterally outer strut walls 16 and 17, and the outer strut walls 16 and 17 are about equilateral, and are about parallel longitudinally and laterally with the intermediate strut wall 13. Forward and rearward lateral ends of the outer strut walls 16 and 17 are connected by pairs of slanted connecting outer and inner walls, the outer pair being designated 18 and 19 and the inner pair being designated 20 and 21 in FIG. 1, thus having the slanted connecting outer walls 18 and 19 diverge from the slanted connecting inner walls 20 and 21 an amount progressively increasing from the hexagonal wall member 12 toward the outer strut walls 16 and 17. The outer strut walls 16 and 17 are bases of generally triangular tubular members 40 and 41 having the slanted connecting walls 18, 19, 20 and 21 all about equilateral and apexed at the junctions 27 and 28, in common with the apexes of the side walls 23, 24, 25 and 26 of the hexagonal wall member 12 produced at those same junctions.

Notably, in the FIG. 1 embodiment, four laterally straight diagonal walls provided in gland 10 interconnect, in a truss interrelation, the opposite lateral ends of the first pair of side walls 14 and 15 of the hexagonal wall member 12 with the forward and rearward lateral ends of the outer strut walls 16 and 17. The diagonal wall structure includes the second pair of side walls 23 and 24 of the hexagonal wall member 12, the third pair of side walls 25 and 26 of the hexagonal wall member 12, the slanted pair of connecting outer walls 18 and 19 of the triangular wall members 40 and 41 and the slanted pair of connecting inner walls 20 and 21 of the triangular wall members 40 and 41.

There are longitudinal, forwardly laterally widening open valleys 29 and 30 defined in gland 10 by the second pair of side walls 23 and 24 of the hexagonal wall member 12, and the slanted pair of outer connecting walls 18 and 19 of the triangular wall members 40 and 41, between the opposite lateral ends of the side wall 14 of the hexagonal wall member 12 and the forward lateral ends of the outer strut walls 16 and 17 of the gland. Meanwhile, the gland 10 further is characterized by having longitudinal flutes 31 and 32 which laterally widen open backwardly from the rear of the gland, and the flutes 31 and 32 occur between the opposite lateral ends of the side wall 15 of the hexagonal wall member 12 and the rearward lateral ends of the outer strut walls 16 and 17, and are defined by the third pair of side walls 25 and 26 of the hexagonal wall member 12 and the slanted pair of connecting inner walls 20 and 21 of the triangular wall members 40 and 41.

In the FIG. 1 condition of gland 10, the forward lateral ends of the outer strut walls 16 and 17 and the side wall 14 of the hexagonal wall member 12 are approximately in a first plane in common, further having the rearward lateral ends of the outer strut walls 16 and 17 and the side wall 15 of the hexagonal wall member 12 be approximately in a second plane in common which is parallel with the first plane, with the valleys 29 and 30 and the flutes 31 and 32 all widening open laterally at about the same angle. Gland 10 bi-laterally is about symmetrical from the intermediate strut wall 13 to and including the outer strut walls 16 and 17.

Referring further to the FIG. 1 embodiment, gland 10 is assembled as a component of a gland and mount system which includes a pair of extruded similar mount members 43, such as of metal, each having an outer leg 45 and an inner leg 46 interconnected by a web 47 so as to form a channel. Each mount member 43 further has a flange 48 joined in common to the inner leg 46 and the web 47 of the channel, and the flanges 48 of the mount members extend laterally behind the webs 47 of the channels and are embedded in relatively movable bodies 49 and 50 which form a movement tolerance space 51 with one another, for the bodies 49 and 50, with the mount members 43 as components thereof, relatively to move in response to change in ambient thermal conditions, for altering the width of the movement tolerance space 51.

In the present embodiment, the relatively movable bodies 49 and 50 are sections of a pavement having outer faces 52 and 53 which are flush with the outside faces of legs 45 of the mount members 43, and the channels of the mount members 43 open toward one another within the movement tolerance space 51 and receive the outer strut walls 16 and 17 of gland 10 against the inner faces of the webs 47 inside the channels, while the gland 10 closes off the movement tolerance space 51 at the rear by bridging across that space, having the valleys 29 and 30 outwardly exposed in the movement tolerance space 51 along with the side wall 14 of the hexagonal wall member 12. The forward and rearward lateral ends of the outer strut walls 16 and 17 meanwhile lie adjacent to the outer and inner legs 45 and 46 of the mount member 43 inside the channels, and the side wall 14 of the hexagonal wall member 12 is positioned to be available as a land, while being a component of the I-beam formed by the side walls 14 and 15 with the intermediate strut wall 13 of gland 10. The I-beam is effectively supported to the outer strut walls 16 and 17 by the hereinbefore described four diagonal walls in gland 10 which interconnect the first pair of side walls 14 and 15 of the hexagonal wall member 12 with the inner and outer lateral ends of the outer strut walls 16 and 17, and in this respect the gland will resiliently act should it be pressed and relieved from the outside at the side wall 14 of the hexagonal wall member 12 intermittently by traffic.

Figure 1A:
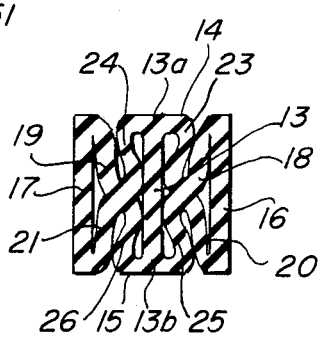

Assuming that the gland 10 is to be compressed, from the relaxed condition thereof represented in FIG. 1, by having the movement tolerance space 51 progressively decreased in width by relative movement of the bodies 49 and 50 toward one another, the outer strut walls 16 and 17 of the gland in this operation advance toward the intermediate strut wall 13, and the slanted connecting inner and outer walls 18, 19, 20 and 21 transmit thrust from the outer strut walls 16 and 17 to the junctions 27 and 28, causing the second and third pairs of side walls 23, 24, 25 and 26 of the hexagonal wall member 12 to flex about the opposite lateral ends of the first pair of side walls 14 and 15 of the hexagonal wall member 12 until the junctions 27 and 28 closely approach the intermediate strut wall 13 and the second and third pairs of side walls 23, 24, 25 and 26 are pressed about entirely facially against the opposite sides of the intermediate strut wall 13, having the valleys 29 and 30 and the flutes 31 and 32 substantially disappear. Meanwhile, the pairs of slanted connecting outer and inner walls 18, 19, 20 and 21 of the gland flex about the forward and rearward lateral ends of the outer strut walls 16 and 17 as the outer strut walls 16 and 17 advance toward the intermediate strut wall 13, and the outer strut walls eventually about entirely facially press against the slanted connecting outer and inner walls 18, 19, 20 and 21, and by then the gland has reached a highly dense approximately fully compressed condition, which is represented in FIG. 1*a*. The I-beam aspect provided by the intermediate strut wall 13, in conjunction with the first pair of side walls 14 and 15 of the hexagonal wall member 12 endures throughout a satisfactorily long compression and relaxation range of the gland 10, and in fact still can be found in the FIG. 1*a* highly compressed condition of the gland.

While the gland 10 is being compressed, the intermediate strut wall 13 is placed in tension, thereby restraining the first pair of side walls 14 and 15 of the hexagonal wall member 12 in their given positions. In this, folding and unfolding actions of the gland are controlled and the side wall 14 of the hexagonal wall member 12 moreover is restrained by the intermediate strut wall 13 against projecting forwardly unduly while width of the gland 10 across the movement tolerance space 51 is being decreased. When the movement tolerance space 51 is becoming wider by relative movement of the bodies 49 and 50, the gland 10, being resilient, unfolds and therefore also widens, such as during change from the FIG. 1*a* compressed form back to the relaxed form in FIG. 1. Actually, the FIG. 1 positions of the relatively movable bodies 49 and 50 have the bodies apart somewhat beyond a maximum which would best be observed if the gland is to remain under compression at least to some extent at all times during use as preferred. By keeping the gland 10 under compression, the gland applies reactive thrust to the outer strut walls 16 and 17 so as to maintain the gland pressed against the mount members 43. The holding action thus developed may of course be supplemented by use of a suitable adhesive between the outer strut walls 16 and 17 and the mount members 43 or by use of any other suitable means for maintaining the gland 10 in system with the mount members. In other instances, the mount members 43 are omitted in favor of fastening the outer strut walls 16 and 17 directly to the relatively movable bodies, such as by means of an adhesive as used in certain other embodiments hereinafter to be described.

In accordance with the FIG. 2 embodiment of this invention, an elastomeric gland 10*a*, also being a product of extrusion, is introduced having structure similar to that described with reference to FIG. 1, but further including a pair of loop walls 70 and 71 projecting backwardly at the rear of gland 10*a* so as to preserve approximate symmetry of the gland 10*a* bi-laterally with reference to the intermediate strut wall 13*a* of the hexagonal wall member 12*a*. The loop walls 70 and 71 have junctions with the rearward lateral ends of the outer strut walls 16*a* and 17*a* in common with rearward lateral ends of a pair of slanted connecting inner walls 20*a* and 21*a* and are joined with the opposite lateral ends of rear side wall 15*a* of the hexagonal wall member 12*a* in common with the rearward lateral ends of the third pair of side walls 25*a* and 26*a* of the hexagonal wall member. The loop walls 70 and 71 are semi-hexagonal walls which define generally pentagonal longitudinally tubular members with side walls 20*a* and 21*a* of the longitudinally tubular triangular wall members 40*a* and 41*a* and the third pair of side walls 25*a* and 26*a* of the hexagonal wall member 12*a*, and produce longitudinally a laterally rearwardly widening recess with the rear side wall 15*a* of the hexagonal wall member 12*a*. Loop walls 70 and 71 add further self-bracing properties to the gland 10*a* and are adapted to fold and unfold along with the remainder of the truss structure of the gland while the gland is being compressed and relieved for that remainder of the truss structure to act in a manner similar to that described with reference to FIG. 1. While the loop walls 70 and 71 have been described as being semi-hexagonal walls, other such reinforcing walls looped having a configuration differing from the semi-hexagonal form may instead be used by way of substitution still in accordance with the practice of this invention.

In the installation according to FIG. 2, the gland 10*a* is combined with two concrete pavement sections 49*a* and 50*a*, thus being situated within a movement tolerance space 51*a* between the sections, having the outer strut walls 16*a* and 17*a* securely against the sections as by bonding through use of a suitable adhesive. In the relative positions of the pavement sections 49*a* and 50*a* in FIG. 2, front side wall 14*a* of the hexagonal wall member 12*a* is about flush with the forward lateral ends of the outer strut walls 16*a* and 17*a* of gland 10*a* and with the outside faces 52*a* and 53*a* of the relatively movable pavement sections. Of course, if desired, gland 10*a* may instead be secured set back in the movement tolerance space 51*a* somewhat from the outside faces 52*a* and 53*a* of the relatively movable pavement sections. Also, as pointed out more generally hereinbefore, the gland 10*a* may be installed partially compressed initially to account for subsequent narrowing and widening of the movement tolerance space 51*a* due to relative movement of the pavement sections within the compression and relaxation range of the gland.

In FIG. 3, the elastomeric gland 10' therein represented is still again a product of extrusion, and includes a generally hexagonal wall member 12' wherein first, second and third pairs of side walls 14' and 15', 23' and 24', and 25' and 26', respectively, are provided having the first of these pairs, 14' and 15', interconnected medially thereof inside the hexagonal wall member 12' by an intermediate strut wall 13' which is disposed centrally between a pair of outer strut walls 16' and 17' of gland 10'. As in the FIG. 1 embodiment, side walls 14', 15', 23', 24', 25' and 26' define six approximately equal obtuse angles with one another, having the side walls 23', 24', 25' and 26' about equilateral in reach, and having the side walls 14' and 15' about equilateral in reach while defining a longitudinally extending I-beam in gland 10' with the intermediate strut wall 13'. Apexes 27' and 28' in the hexagonal wall member 12' occur at junctions of the second pair of side walls 23' and 24' of the hexagonal wall member with the third pair of side walls 25' and 26' of the hexagonal wall member, and the apexes 27' and 28' are about equidistant from opposite sides of the intermediate strut wall 13'. Lateral reach of the first pair of side walls 14' and 15' of the hexagonal wall member is shown in FIG. 3 to be about equal to that of each of the side walls 23', 24', 25' and 26' in the second and third pairs in the hexagonal wall member, though in certain embodiments, still in accordance with the present invention, the reach of the first pair of side walls is either increased or decreased somewhat from that which is shown.

Gland 10' is further characterized by including an inner pair of slanted connecting walls 20' and 21' which join with the rearward lateral ends of the outer strut walls 16' and 17' and form laterally straight diagonal walls with the second pair of side walls 23' and 24' of the hexagonal wall member 12'. These two straight diagonal walls therefore extend through the apexes 27' and 28' and join the opposite lateral ends of the front side wall 14' of the hexagonal wall member 12' with the rearward lateral ends of the outer strut walls 16' and 17'. An outer pair of slanted connecting walls 18' and 19' have junctions 60 and 61 with the second pair of side walls 23' and 24' of the hexagonal wall member 12', between the opposite lateral ends of front side wall 14' of the hexagonal wall member and the apexes 27' and 28', and connect the second pair of side walls 23' and 24' with the forward lateral ends of the outer strut walls 16' and 17'. Junctions 60 and 61 are about equidistantly removed from the opposite lateral ends of the front side wall 14', and also are about equidistantly removed from the apexes 27' and 28', and preferably are about half way between the opposite lateral ends of the front side wall 14' and the apexes 27' and 28' or nearer than that to the apexes 27' and 28'.

In laterally extending outwardly from the hexagonal wall member 12', the pair of slanted connecting outer walls 18' and 19' progressively diverge from the inner pair of slanted connecting walls 20' and 21' and form longitudinally extending valleys 29' and 30' at about equal angles with the second pair of side walls 23' and 24' of the hexagonal wall member 12', between the opposite lateral ends of the front side wall 14' of the hexagonal wall member 12' and the forward lateral ends of the outer strut walls 16' and 17'. At the rear of the gland 10', there are about equi-angular longitudinal flutes 31' and 32' formed by the inner pair of slanted intermediate connecting walls 20' and 21' with the third pair of side walls 25' and 26' of the hexagonal wall member 12', between the opposite lateral ends of the rear side wall 15' and the rearward lateral ends of the outer strut walls 16' and 17'. The outer pair of slanted connecting walls 18' and 19' are about equilateral in the pair and so are the slanted connecting inner walls 20' and 21' about equilateral in the pair. There are two longitudinal tubular generally triangular passageways through the gland, these being defined by the outer strut walls 16' and 17' and the slanted connecting walls 18', 19', 20' and 21' with portions of the second pair of side walls 23' and 24' of the hexagonal wall member 12'. Gland 10' is approximately symmetrical in structure bilaterally from the intermediate strut wall 13' to and including the outer strut walls 16' and 17'. In the FIG. 3 embodiment, the installation including gland 10' is similar to that in FIG. 1, and therefore will not be further described.

The substantially fully compressed condition of gland 10', as represented in FIG. 3*a*, is arrived at from the FIG. 3 relaxed condition through advancing the outer strut walls 16' and 17' along with the relatively movable bodies 49' and 50' toward the intermediate strut wall 13'. During this movement, the slanted connecting walls 18', 19', 20' and 21' apply thrust to the second and third pairs of side walls 23', 24', 25' and 26', causing the latter four side walls to flex elastically about the opposite lateral ends of side walls 14' and 15' in the hexagonal wall member 12' and come into contact with the opposite sides of the intermediate strut wall 13' inside the hexagonal wall member 12'. The slanted connecting outer and inner connecting walls 18', 19', 20' and 21' meanwhile flex elastically about the opposite lateral ends of the outer strut walls 16' and 17' until the four slanted connecting walls act facially against the outer strut walls 16' and 17', and finally the gland 10' attains the FIG. 3*a* compressed condition wherein, notably, the I-beam aspect provided by the intermediate strut wall 13' in conjunction with the first pair of side walls 14' and 15' of the hexagonal wall member 12' still exists, while the intermediate strut wall 13' restrains the side walls 14' and 15' of the hexagonal wall member 12' against distending and the valleys 29' and 30' and the flutes 31' and 32' are substantially erased. When the relatively movable bodies 49' and 50' thereafter undergo movement so as to widen the movement tolerance space 51', the gland 10' elastically follows in that movement and widens such as back to the FIG. 3 condition. Through having the two diagonal walls, formed by the second pair of side walls 23' and 24' and by the inner pair of slanted connecting walls 20' and 21', the gland 10' is well braced, counting too the bracing effect of the outer pair of slanted connecting walls 18' and 19' and that of the outer strut walls 16' and 17' in conjunction with the I-beam feature of the side walls 14' and 15' of the hexagonal wall member 12' and the intermediate strut wall 13'. The folding and unfolding action of the gland 10' moreover is satisfactory throughout the compression and relaxation range of the gland, and the gland resiliently responds favorably, such as in the FIG. 3 environment, to loads which are applied to and relieved from side wall 14' of the hexagonal wall member under traffic conditions.

An elastomeric gland 10*b* according to the embodiment represented in FIG. 4 is in an installation similar to that of FIG 2, and is also a product of extrusion similar to the gland in FIG. 3, with additionally having a pair of loop walls 70' and 71' interconnecting opposite lateral ends of the hexagonal wall member side wall 15*b* with rearward lateral ends of the strut walls 16*b* and 17*b* and of the slanted connecting walls 20*b* and 21*b* to provide further self-bracing properties. The loop walls 70' and 71', being semi-hexagonal in form produce a pair of longitudinal, generally pentagonal passageways through the gland with the remainder of the truss structure of the gland, and fold and unfold elastically in keeping with the action of the remainder of the gland as described with reference to FIG. 3. Gland 10*b* is approximately symmetrical bi-laterally from the intermediate strut wall 13*b* to and including the outer strut walls 16*b* and 17*b* The configuration of the loop walls 70' and 71', though described as being semi-hexagonal, may in certain other embodiments, still in accordance with the present invention, be modified to be of any other suitable configuration consistent with providing bracing effects and tolerating a worthwhile folding and unfolding action of the gland.

The present invention is, of course, in no way restricted to the specific disclosure of the specification and drawings herein, but also encompasses any modifications within the scope of the appended claims.

I claim:

1. An elastomeric gland for use inside a movement tolerance space between relatively movable bodies, said gland comprising; a generally hexagonal wall member tubular longitudinally of said gland and an intermediate strut wall interconnecting a first pair of side walls of said hexagonal wall member medially of said first pair of side walls inside said hexagonal wall member, thereby producing an I-beam aspect with said first pair of side walls of said hexagonal wall member prior to said hexagonal wall member being compressed, and second and third pairs of side walls of said hexagonal wall member interconnecting opposite lateral ends of said first pair of side walls and forming a pair of apexes spaced oppositely of said intermediate strut wall about equidistantly from opposite sides of said intermediate strut wall, and said gland further including, opposite end means to be against said relatively movable bodies when said gland is inside said movement tolerance space, and two pairs of slanted connecting walls connected with said second and third pairs of side walls of said hexagonal wall member and with said opposite end means, having said connections with said second and third pairs of side walls of said hexagonal wall member contiguous to said pair of apexes and removed in one of said pairs of slanted connecting walls about equidistantly from said opposite lateral ends of one of said side walls in said first pair of side walls of said hexagonal wall member and removed in the other of said pair of slanted connecting walls about equidistantly from said opposite lateral ends of the other of said side walls in said first pair of side walls of said hexagonal wall member, and having said slanted connecting walls in said one of said two pairs diverge with reference to said slanted connecting walls in said other of said two pairs as said slanted connecting walls lead away from said hexagonal wall member, for said second and third pairs of side walls of said hexagonal wall member to be flexed about said opposite lateral ends of said first pair of side walls of said hexagonal wall member under thrust from said two pairs of slanted connecting walls and thereby carry said pair of apexes toward said opposite sides of said intermediate strut wall and ultimately, when said gland is fully compressed, have said second and third pairs of side walls of said hexagonal wall member be side facially against said opposite sides of said intermediate strut wall, with said first pair of side walls of said hexagonal wall member and said intermediate strut wall still appreciably preserving said I-beam aspect.

2. An elastomeric gland as set forth in claim 1, wherein said slanted connecting walls are joined to said second and third pairs of side walls of said hexagonal wall member contiguous to said pair of apexes and thus remote from said opposite lateral ends of said first pair of side walls of said hexagonal wall member by at least about half way between said opposite lateral ends of said first pair of side walls of said hexagonal wall member and said pair of apexes.

3. An elastomeric gland as set forth in claim 1, wherein said second pair of side walls of said hexagonal wall member lead from said other of said side walls in said first pair of side walls of said hexagonal wall member and are in a pair of diagonal walls with said one of said two pairs of slanted connecting walls leading from front to back of said gland, having said one of said two pairs of slanted connecting walls connected to said apexes of said hexagonal wall member and said other of said two pairs of slanted connecting walls connected to said second pair of side walls of said hexagonal wall member intermediately of said pair of apexes of said hexagonal wall member and said opposite lateral ends of said other of said side walls in said first pair of side walls of said hexagonal wall member.

4. An elastomeric gland as set forth in claim 3, wherein said other of said two pairs of slanted connecting walls are joined to said second pair of side walls of said hexagonal wall member more proximate to said pair of apexes than to said opposite lateral ends of said other side wall in said first pair of side walls of said hexagonal wall member.

5. An elastomeric gland as set forth in claim 1, wherein said other of said two pairs of slanted connecting walls and said other of said side walls in said first pair of side walls of said hexagonal wall member are forward in said gland and said other of said two pairs of slanted connecting walls are joined to said second pair of side walls of said hexagonal wall member at a pair of intersections situated at least about half way between said opposite lateral ends of said other of said side walls in said first pair of side walls of said hexagonal wall member and said pair of apexes from said opposite lateral ends of said other of said side walls in said first pair of side walls of said hexagonal wall member.

6. An elastomeric gland as set forth in claim 5, wherein said intersections are more proximate to said pair of apexes than to said opposite lateral ends of said other of said side walls in said first pair of side walls of said hexagonal wall member.

7. An elastomeric gland as set forth in claim 5, wherein said gland further includes a pair of loop wall structures and longitudinally is hollow next to said loop wall structures within closed boundaries afforded by said loop wall structures, by said one of said two pairs of slanted connecting walls and by said third pair of side walls of said hexagonal wall member.

8. An elastomeric gland as set forth in claim 7, wherein said gland is generally pentagonally hollow inside said boundaries.

9. An elastomeric gland as set forth in claim 1, wherein said second and third pairs of side walls of said hexagonal wall member and said two pairs of slanted connecting walls form two pairs of diagonal walls, in pair having intersections at said pair of apexes of said hexagonal wall member.

10. An elastomeric gland as set forth in claim 9, wherein said one of said side walls in said first pair of side walls of said hexagonal wall member is situated at the rear of said gland and has opposite lateral ends connected by a pair of loop wall structures with rearward lateral portions of said opposite end means of said gland, and said gland longitudinally is hollow within closed boundaries afforded by said pair of loop wall structures, by said one of said two pairs of slanted connecting walls, and by said said third pair of side walls of said hexagonal wall member situated rearwardly in said gland relatively to said second pair of side walls of said hexagonal wall member.

11. An elastomeric gland as set forth in claim 10, wherein said gland is generally pentagonally hollow inside said boundaries.

12. An elastomeric gland as set forth in claim 1, wherein said side walls in said first pair of side walls of said hexagonal wall member are respectively front and back side walls of said hexagonal wall member, having said second pair of side walls connected with opposite lateral ends of said front side wall and said third pair of side walls connected with opposite lateral ends of said back wall and forming said pair of apexes with said second pair of side walls, and said gland further includes a pair of loop wall structures and longitudinally is hollow next to said loop wall structures within closed boundaries afforded by said pair of loop wall structures, by said one of said two pairs of slanted connecting walls and by said hexagonal wall member along said third pair of side walls of said hexagonal wall member.

13. An elastomeric gland as set forth in claim 1, wherein said hexagonal wall member interiorily forms two generally pentagonal longitudinal passageways through said gland with said intermediate strut wall.

14. An elastomeric gland for use inside a movement tolerance space between relatively movable bodies, said gland comprising; a generally hexagonal wall member tubular longitudinally of said gland and an intermediate strut wall interconnecting a first pair of side walls of said hexagonal wall member medially of said first pair of side walls inside said hexagonal wall member, thereby presenting an I-beam aspect with said first pair of side walls of said hexagonal wall member prior to said hexagonal wall member being compressed, and second and third pairs of side walls of said hexagonal wall member interconnecting opposite lateral ends of said first pair of side walls and forming a pair of apexes spaced oppositely of said intermediate strut wall about equidistantly from opposite sides of said intermediate strut wall, and side end and connecting structure comprising, a pair of outer strut walls to be against said relatively movable bodies when said gland is inside said movement tolerance space, and two pairs of slanted connecting walls connected with said second and third pairs of side walls of said hexagonal wall member and with opposite lateral ends of said pair of outer strut walls, having said connections with said second and third pairs of side walls of said hexagonal wall member contiguous to said pair of apexes and removed in one of said pairs of slanted connecting walls about equidistantly from said opposite lateral ends of one of said side walls in said first pair of side walls of said hexagonal wall member and removed in the other of said pair of slanted connecting walls about equidistantly from said opposite lateral ends of the other of said side walls in said first pair of side walls of said hexagonal wall member, and having said slanted connecting walls in said one of said two pairs diverge with reference to said slanted connecting walls in said other of said two pairs as said slanted connecting walls lead away from said hexagonal wall member, for said pair of outer strut walls to be moved toward said pair of apexes of said hexagonal wall member having said slanted connecting walls flex about said opposite lateral ends of said pair of strut walls and for said second and third pairs of side walls of said hexagonal wall member to flex about said opposite lateral ends of said first pair of side walls of said hexagonal wall member under thrust from said two pairs of slanted connecting walls and thereby carry said pair of apexes toward said opposite sides of said intermediate strut wall and ultimately, when said gland is fully compressed, have said second and third pairs of side walls of said hexagonal wall member be side facially against said opposite sides of said intermediate strut wall and said outer pair of strut walls be side facially against said slanted connecting walls, with said first pair of side walls of said hexagonal wall member and said intermediate strut wall still appreciably preserving said I-beam aspect.

15. An elastomeric gland as set forth in claim 14, wherein said second pair of side walls of said hexagonal wall member lead from said other of said side walls in said first pair of side walls of said hexagonal wall member, said second pair of side walls of said hexagonal wall member and said one of said two pairs of slanted connecting walls are in a pair of diagonal walls leading from front to back of said gland, having said one of said two pairs of slanted connecting walls connected to said pair of apexes of said hexagonal wall member, and the other of said two pairs of slanted connecting walls connected to said second pair of side walls of said hexagonal wall member intermediately of said pair of apexes of said hexagonal wall member and said opposite lateral ends of said other of said side walls in said first pair of side walls of said hexagonal wall member.

16. An elastomeric gland as set forth in claim 15, wherein said slanted connecting walls in said other pair are joined to said second pair of side walls of said hexagonal wall member at intersections therewith removed from said opposite lateral ends of said other of said side walls in said first pair of side walls of said hexagonal wall member by at least about half way between said opposite lateral ends of said other of said side walls in said first pair of side walls of said hexagonal wall member and said pair of apexes, and said hexagonal wall member interiorily forms two generally pentagonal longitudinal passageways through said gland with said intermediate strut wall, while said pairs of slanted connecting walls and said pair of outer strut walls form generally triangular longitudinal passageways through said gland with portions of said second pair of side walls of said hexagonal wall member.

17. An elastomeric gland as set forth in claim 16, wherein said gland further includes a pair of loop wall structures and longitudinally is hollow within closed boundaries afforded by said pair of loop wall structures, by said one of said pairs of slanted connecting walls, and by said third pair of side walls of said hexagonal wall member.

18. An elastomeric gland as set forth in claim 17, wherein said gland is generally pentagonally hollow within said boundaries.

19. An elastomeric gland as set forth in claim 14, wherein said second and third pairs of side walls of said hexagonal wall member and said two pairs of slanted connecting walls form two pairs of diagonal walls extending from front to back of said gland, and said diagonal walls have intersections in said pairs thereof at said pair of apexes of said hexagonal wall member.

20. An elastomeric gland as set forth in claim 19, wherein said hexagonal wall member interiorily forms two generally pentagonal passageways through said gland with said intermediate strut wall, while said pair of outer strut walls form generally triangular longitudinal passageways through said gland with said two pairs of slanted connecting walls.

21. An elastomeric gland as set forth in claim 20, wherein said gland further includes a pair of loop wall structures and longitudinally is hollow within closed boundaries afforded by said one of said two pairs of slanted connecting walls and by either said second and third pairs of side walls of said hexagonal wall member.

22. An elastomeric gland as set forth in claim 21, wherein said gland is generally pentagonally hollow within said boundaries.

* * * * *